US006658882B2

(12) United States Patent
Ohama et al.

(10) Patent No.: US 6,658,882 B2
(45) Date of Patent: Dec. 9, 2003

(54) INTEGRAL-TYPE AIR CONDITIONER

(75) Inventors: Yasunori Ohama, Gunma (JP); Kiyoshi Kobayashi, Tochigi (JP); Takuya Kajita, Tochigi (JP); Harutaka Genno, Gunma (JP); Junichi Gouya, Gunma (JP); Keiko Kajita, Tochigi (JP)

(73) Assignees: Sanyo Electric Co., Ltd., Moriguchi (JP); Sanyo Electric Air Conditioning Co., Ltd., Tochigi (JP)

( * ) Notice: Subject to any disclaimer, the term of this patent is extended or adjusted under 35 U.S.C. 154(b) by 0 days.

(21) Appl. No.: 10/214,375

(22) Filed: Aug. 6, 2002

(65) Prior Publication Data

US 2003/0029184 A1 Feb. 13, 2003

(30) Foreign Application Priority Data

Aug. 9, 2001 (JP) ..... 2001-242038
Sep. 4, 2001 (JP) ..... 2001-266926
Sep. 5, 2001 (JP) ..... 2001-268588

(51) Int. Cl.[7] ..... F25D 23/12; F25D 21/06; F25D 21/14; F25D 29/44

(52) U.S. Cl. ..... 62/262; 62/275; 62/259.1; 62/263; 62/285; 62/288; 62/289; 62/291; 415/208.1

(58) Field of Search ..... 62/262, 263, 259.1, 62/275, 285, 288, 289, 291; 475/208.1

(56) References Cited

U.S. PATENT DOCUMENTS 5,295,531 A * 3/1994 Tsunekawa et al. ..... 165/48.1
5,372,189 A * 12/1994 Tsunekawa et al. ..... 62/262
5,884,500 A * 3/1999 Wetzel ..... 62/259.1
6,412,298 B2 * 7/2002 Kang et al. ..... 62/262

FOREIGN PATENT DOCUMENTS

JP Hei-6-2886 1/1994

* cited by examiner

*Primary Examiner*—Timothy L. Maust
*Assistant Examiner*—Filip Zec
(74) *Attorney, Agent, or Firm*—Darby & Darby

(57) ABSTRACT

In an air conditioner (10) including an indoor-side chamber (21) containing an indoor heat exchanger (11) and an indoor fan (12), and an outdoor-side chamber (22) containing outdoor heat exchanger (13) and an outdoor fan (14), the indoor-side chamber (21) and the outdoor-side chamber (22) being partitioned by a partition plate (20), the partition plate (2) has a top panel (42) having a ventilation opening portion and a ventilation shutter (49) for opening/closing said ventilation opening portion (48) to freely adjust the opening degree of said ventilation opening portion (48). An indoor fan casing (34) having a heater lower-portion mounting portion (64) located above a drain pan (33) is provided between the indoor fan (12) and the partition plate (20), and an electrical heater (55) is disposed on the heater lower-portion mounting portion (64) so that the electric heater (55) is located above the drain pan (33) through the lower-portion mounting portion (64). The outdoor fan (14) comprises an axial fan (14), and an air guide member is equipped at the suction side of the axial fan (14) to surely guide the air at the suction side of said axial fan to the axial fan.

8 Claims, 13 Drawing Sheets

INTEGRAL-TYPE AIR CONDITIONER

This application claims the priority of Japanese patent application No. 2001–242038, which was filed on Aug. 9, 2001, Japanese patent application No. 2001–266926, which was filed on Sep. 4, 2001, and Japanese patent application No. 2001–268588, which was filed on Sep. 5, 2001, which are hereby incorporated by reference in their entirety.

BACKGROUND OF THE INVENTION

1. Field of the Invention

The present invention relates to an integral-type air conditioner in which an indoor heat exchanger, an indoor fan, an outdoor heat exchanger and an outdoor fan are integrally fabricated.

2. Description of the Related Art

There has been known an integral-type air conditioner in which an indoor heat exchanger, an indoor fan, an outdoor heat exchanger and an outdoor fan are integrally fabricated and also an indoor side chamber having the indoor heat exchanger and the indoor fan arranged therein and the inside of the air conditioner is partitioned into an outdoor side chamber having the outdoor heat exchanger and the outdoor fan arranged therein by a partition plate. Japanese Laid-open Patent Application No. Hei-6-2886 discloses one of such integral-type air conditioners.

The air conditioner disclosed in the above publication has indoor and outdoor-side chambers which are partitioned by a partition plate. An indoor heat exchanger, an electrical heater and a cross-flow fan are arranged in this order in the indoor-side chamber, and an outdoor heat exchanger and an outdoor fan device are arranged in the outdoor-side chamber.

In the air conditioner thus constructed, a ventilation port through which the outside air is selectively supplied into the indoor-side chamber is formed in the partition plate, and a ventilation door is pivotally equipped to the partition plate through a hinge. The ventilation port is selectively opened/closed by opening/closing the ventilation door. When the ventilation port is made open by opening the ventilation door, the outside air is passed through the outdoor-side chamber and the ventilation port in this order and introduced into the indoor-side chamber. The outside air thus introduced is guided into the room together with the indoor air heat-exchanged by an indoor heat exchanger in the indoor-side chamber, thereby ventilating the room.

Further, in the above-described air conditioner, the electrical heater is disposed in the indoor-side chamber so as to be adjacent to the indoor heat exchanger. The indoor air heat-exchanged by the indoor heat exchanger is also heated by the electrical heater and then blown out to the room, thereby heating the inside of the room. Here, the indoor heat exchanger is mounted on a drain pan, and drain water occurring on the indoor heat exchanger is collected in the drain pan. The electrical heater is located above the drain pan.

Still further, in the above-described air conditioner, the outdoor fan device comprises a propeller fan device. The outdoor fan device has an outdoor motor mounted on a support leg disposed in the outdoor-side chamber, and the propeller fan is rotated by the outdoor motor. The outdoor motor is disposed at the air-suction side of the propeller side, and the air around the outdoor motor is sucked into the propeller fan by the rotation of the propeller fan. The air thus sucked is blown out to the outdoor heat exchanger.

In the above-described air conditioner, the ventilation device needs not only the ventilation door and the hinge, but also a wire through which the opening/closing operation of the ventilation door is carried out, an operation knob equipped to one end of the wire and other kinds of parts such as an air filter, etc. mounted at the ventilation port. Therefore, the ventilation device itself needs a large number of parts to selectively supply the outside air into the indoor-side chamber, and it must be designed in a complicated structure.

In addition, the above ventilation device is designed in a door structure, and thus only the full-opening/full-closing operation of the ventilation port is allowed. Therefore, it is impossible to adjust the opening degree of the ventilation port. Further, when the ventilation port is kept opened under terrible storm such as hurricane or the like, strong rain and window may pass through the ventilation port and invades into the indoor-side chamber, so that the room is exposed to rain.

Further, if the outside damp air passes through the opened ventilation port into the indoor-side chamber under cooling operation, the damp air is brought into contact with the indoor fan, etc. cooled under cooling operation in the indoor-side chamber to induce dew condensation, so that dew drops thus induced are scattered into the room.

In the above-described air conditioner, the electrical heater is installed in the indoor-side chamber while suspended by a stabilizer mounted at the upper portion of the indoor heat exchanger. Accordingly, the installation precision of the electrical heater is dependent on the fixing precision of the electrical heater to the stabilizer and the fixing precision of the stabilizer to the indoor heat exchanger. As a result, the installation of the electrical heater must be performed sufficiently carefully. In addition, the electrical heater is located above the drain pan as described above, however, the radiation heat of the electrical heater to the drain pan is not sufficiently intercepted, so that the drain pan may be thermally distorted when it is formed of foam polystyrene or the like.

In the above-described air conditioner, the air around the outdoor motor is sucked into the propeller fan by the rotation of the propeller fan. At this time, the air streams flowing from the opposite sides to the propeller fan in the opposite directions comes into collision with each other, so that turbulence may occur in the air flow. Therefore, the amount of the air sucked into the propeller fan may be reduced, so that the amount of the air blown out by the propeller is reduced.

SUMMARY OF THE INVENTION

Therefore, the present invention has implemented from the view of the foregoing situation, and an object of the present invention is to provide an integral-type air conditioner that can perform excellent ventilation with a simple construction.

The present invention has another object to provide an integral-type air conditioner that can enhance installation of a heater, and still further object to provide an integral-type air conditioner that can prevent a drain pan from being thermally distorted by the heater.

The present invention has still further object to provide an axial fan device that can increase a fan discharging amount (air blow-out amount from a fan), and also provide an integral-type air conditioner having the axial fan device.

In order to attain the above objects, according to the present invention, according to a first aspect of the present invention, there is provided an air conditioner (10) comprising an indoor heat exchanger (11), an indoor fan (12), an outdoor heat exchanger (13) and an outdoor fan (14) which are integrally equipped, the indoor heat exchanger (11) and the indoor fan (12) being disposed in an indoor-side chamber (21) while the outdoor heat exchanger (13) and the outdoor fan (14) is disposed in an outdoor-side chamber (22), the indoor-side chamber (21) and the outdoor-side chamber (22) being partitioned by a partition plate (20), characterized in that the partition plate (2) is equipped with a top panel (42) having a ventilation opening portion through which the outside air is supplied from the outdoor-side chamber (22) into the indoor-side chamber (21), and a ventilation shutter (49) for opening/closing the ventilation opening portion (48) of the top panel (42) at any open area ratio to freely adjust the opening degree of the ventilation opening portion (48).

In the air conditioner, the ventilation shutter (49) is secured to the top panel (42) so as to be freely slidable, and the opening degree of the ventilation opening portion (48) is freely adjusted through the sliding motion of the ventilation shutter (49).

The air conditioner further comprises a cabinet (19), wherein the cabinet (19) is designed in a sleeve shape, and the surrounding of the outdoor-side chamber (22) is compartmented by the cabinet (19), and the top panel (42) of the partition plate (20) is disposed inside the cabinet (19).

In the air conditioner, the top panel (42) of the partition plate (20) is designed to be downwardly inclined to the outdoor-side chamber (22).

The air conditioner further comprises a fan casing (34) disposed between the partition plate (20) and the indoor fan (12) in the indoor-side chamber, wherein vent ports (50) are formed at the lower portion of the fan casing (34), and the outside air introduced from the ventilation opening portion (48) of the partition plate (20) into the indoor-side chamber (21) is guided to the indoor fan (12) through the vent ports (50A).

In the air conditioner, the ventilation opening portion (48) comprises plural ventilation ports that are formed in the top panel (42) in juxtaposition with one another.

In the air conditioner, the ventilation shutter (49) is equipped with a large number of fine holes (51) each having an opening area smaller than each of the ventilation ports (48).

In the air conditioner, the ventilation shutter (49) is equipped with a lever (54) extending to the indoor-side heat exchanger side, the opening degree of the ventilation ports (48) being adjusted by sliding the lever (54).

According to a second aspect of the present invention, there is provided an air conditioner (10) comprising an indoor heat exchanger (11), an indoor fan (12), an outdoor heat exchanger (13) and an outdoor fan (14) which are integrally equipped, the indoor heat exchanger (11) and the indoor fan (12) being disposed in an indoor-side chamber (21) while the outdoor heat exchanger (13) and the outdoor fan (14) is disposed in an outdoor-side chamber (22), the indoor-side chamber (21) and the outdoor-side chamber (22) being partitioned by a partition plate (20), characterized by further comprising an indoor fan casing (34) that is disposed between the indoor fan (12) and the partition plate (20) in the indoor-side chamber (21) and guides air flow induced by rotation of the indoor fan (12), and an electrical heater (55) disposed in the indoor-side chamber (21) for heating the air, wherein the indoor fan casing (34) has a heater lower-portion mounting portion (64) in which the lower portion of the electrical heater is mounted.

In the air conditioner, the heater lower-portion mounting portion (64) has a guide face (65) having a tapered shape that is upwardly increased in cross-sectional area from the lower end thereof to the upper end thereof.

The air conditioner further comprises a drain pan (33) for withdrawing water occurring on the indoor heat exchanger (11), wherein the electrical heater (55) is disposed to be above the drain pan (33) through the heater lower-portion mounting portion (64) and adjacent to the indoor heat exchanger (11), and the lower end portion of the electrical heater (55) is wholly covered by the heater lower-portion mounting portion (64).

In the air conditioner, the heater lower-portion mounting portion (64) of the indoor fan casing (34) is disposed to be spaced from the drain pan (33) at a predetermined distance.

According to a third aspect of the present invention, there is provided an air conditioner (10) including an indoor heat exchanger (11), an indoor fan device (12), an outdoor heat exchanger (13) and an outdoor fan device (164) which are integrally equipped, the indoor heat exchanger (11) and the indoor fan (12) being disposed in an indoor-side chamber (21) while the outdoor heat exchanger (13) and the outdoor fan (14) is disposed in an outdoor-side chamber (22), the indoor-side chamber (21) and the outdoor-side chamber (22) being partitioned by a partition plate (20), characterized in that the outdoor fan device (164) comprises an axial fan (14) for sucking the air at the suction side thereof and blowing out the air thus sucked to the outdoor heat exchanger (13) through rotation of the axial fan (14), and an air guide member disposed at the suction side of the axial fan (14) for guiding the air at the suction side of the axial fan to the axial fan.

In the air conditioner, the outdoor fan device (164) further comprises a driving motor (25) for driving the axial fan (14) and a support member (24) for supporting the driving motor (25), wherein the air guide member is fixed to the support member (24).

In the air conditioner, the air guide member comprises at least two air guide plates (161,162) that are equipped to the support member so as to be raised from the support member (24) at a predetermined angle, and air holes (159, 160) formed in the support member (24) in connection with the air guide plates (161, 162), the flow of the air at the suction side of the axial fan (14) being deflected to the air holes (159, 160) by the air guide plates (161, 162) and then sucked through the air holes (159, 160) into the axial fan (14).

In the air conditioner, the air guide plates (161, 162) are raised from the support member (24) substantially in the perpendicular direction to the air flow at the suction side of the axial fan.

In the air conditioner, the air guide plates (161, 162) are raised from the support member (24) so as to be inclined in a direction confronting the air flow direction at the suction side of the axial fan (14).

In the air conditioner, the air guide plates (161, 162) are integrally formed with the support member (24).

In the air conditioner, the whole or a part of each of the air guide plates (161, 162) is disposed within the outer peripheral edge of the axial fan.

DETAILED DESCRIPTION OF THE PREFERRED EMBODIMENTS

Preferred embodiments according to the present invention will be described hereunder with reference to the accompanying drawings.

Figure 1:
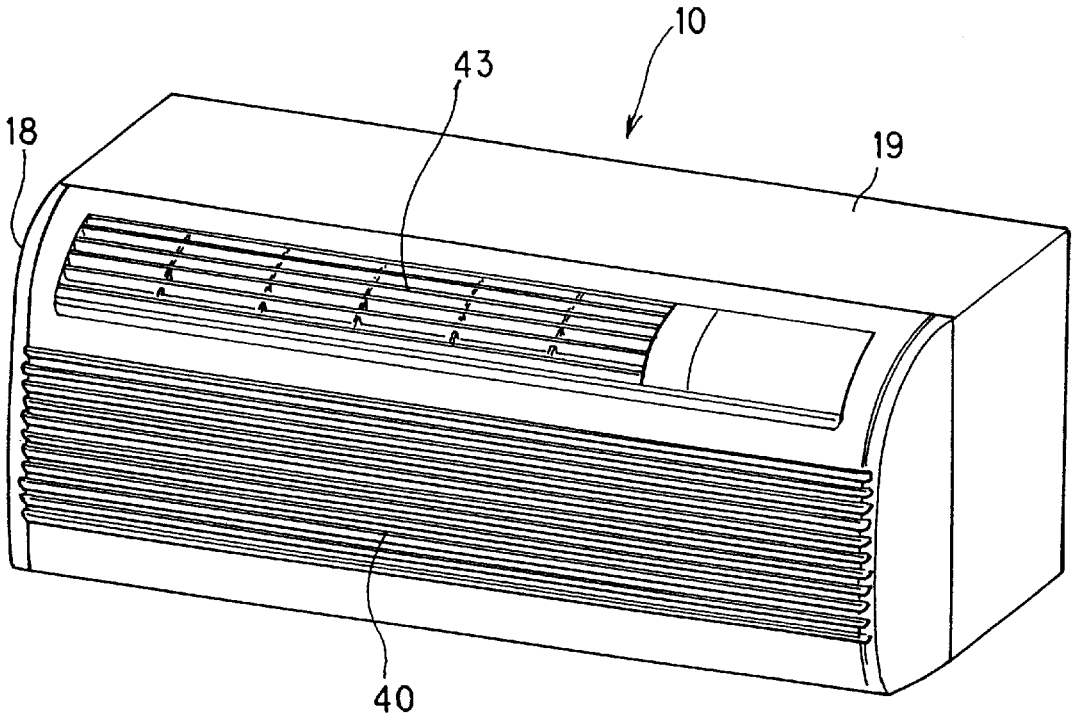
FIG. 1 is a perspective view showing the outlook of an embodiment of an air conditioner according to the present invention.
Figure 2:
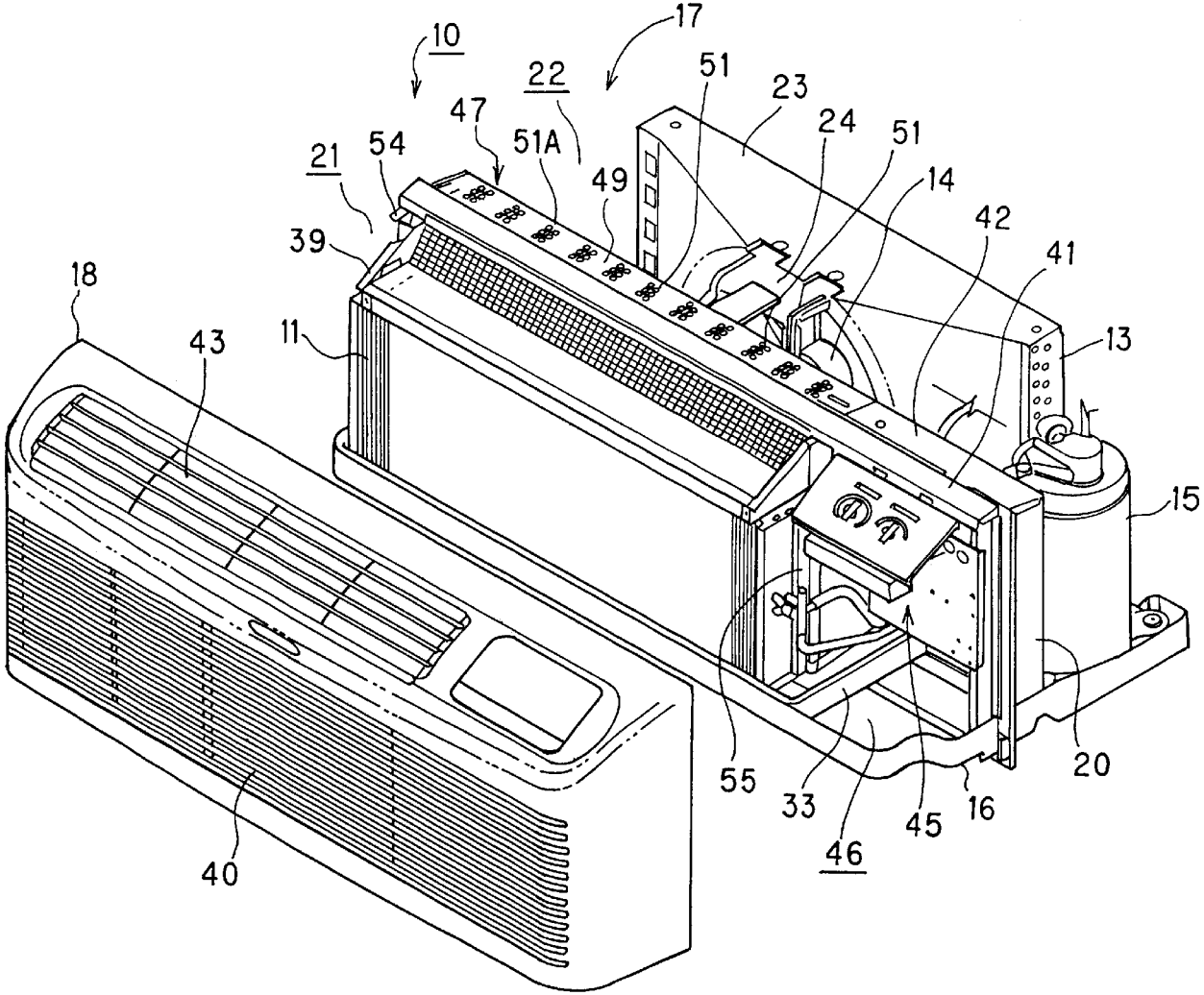
FIG. 2 is an exploded perspective view showing the air conditioner of FIG. 1 when a cabinet is omitted from the illustration.

FIG. 1 is a perspective view showing the outlook of an embodiment of an air conditioner according to the present invention, and FIG. 2 is an exploded perspective view showing the air conditioner of FIG. 1 when a cabinet is omitted from the illustration.

The air conditioner 10 shown in FIGS. 1 and 2 is an integral-type air conditioner which is set up while penetrating through the wall of a building (not shown), and it comprises an indoor heat exchanger 11, a cross-flow fan 12 (FIG. 3) serving as an indoor fan, an outdoor heat exchanger 13, a propeller fan 14 serving as an outdoor fan, a compressor 15, etc. which are integrally fabricated.

The indoor heat exchanger 11, the cross-flow fan 12, the outdoor heat exchanger 13, the propeller fan 14, the compressor 15, etc. are disposed on the bottom plate 16 to constitute the main body 17 of the air conditioner. The front side of the air-conditioner main body 17 (that is, the arrangement side of the indoor heat exchanger 11 and the cross-flow fan 12) is covered by a front panel 18, and the rear side thereof (that is, the arrangement side of the outdoor heat exchanger 13, the propeller fan 14 and the compressor 15) is covered by a cabinet 19. The front panel 18 is located to face the inside of the room of the building. The cabinet 19 is set up in the wall of the building while it penetrates through the wall of the building, and the cabinet 19 is designed to have a sleeve-like shape such as a cylindrical shape, a prismatic shape or the like.

Figure 3:
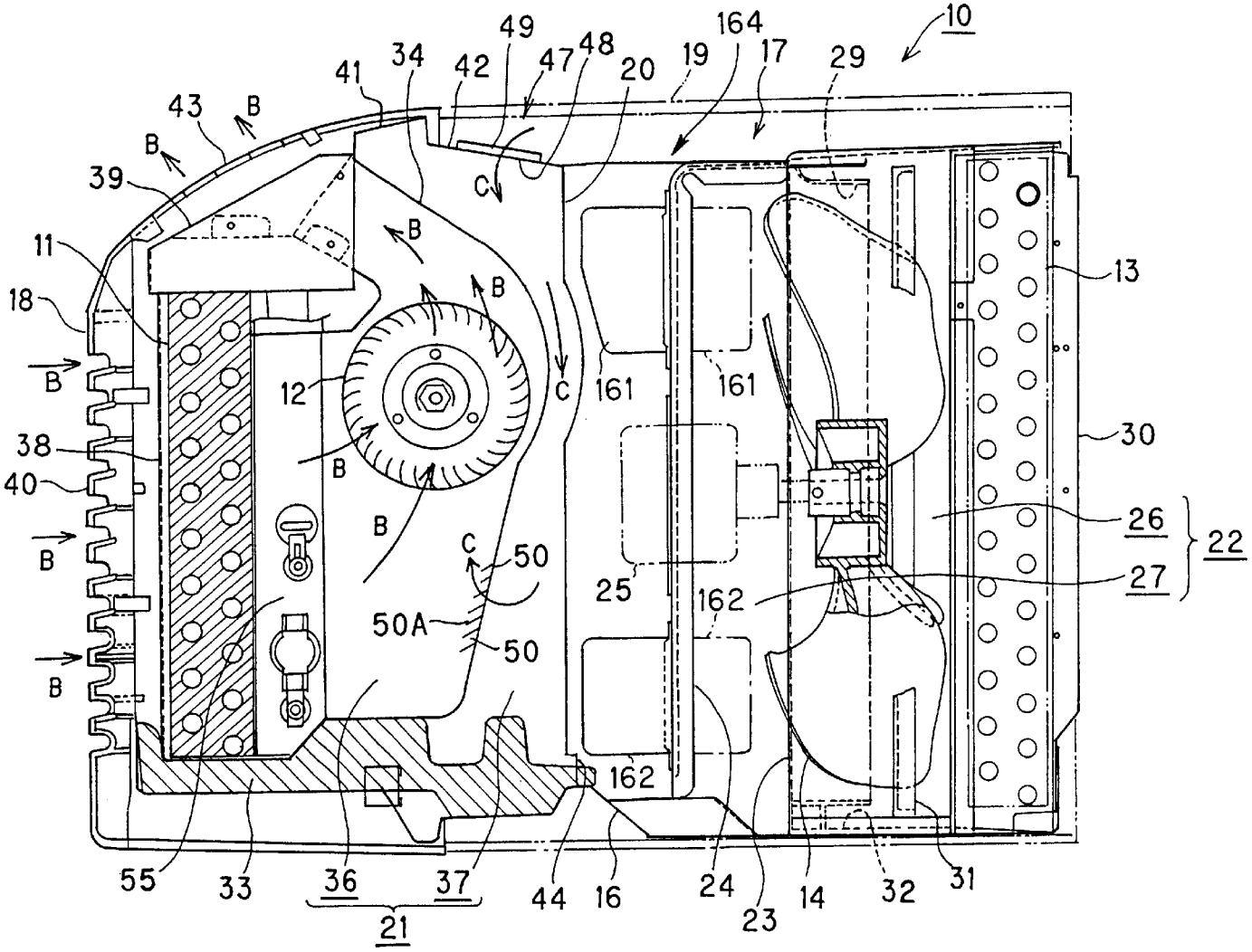
FIG. 3 is a longitudinally-sectional view showing the air conditioner shown in FIG. 1.
Figure 4:
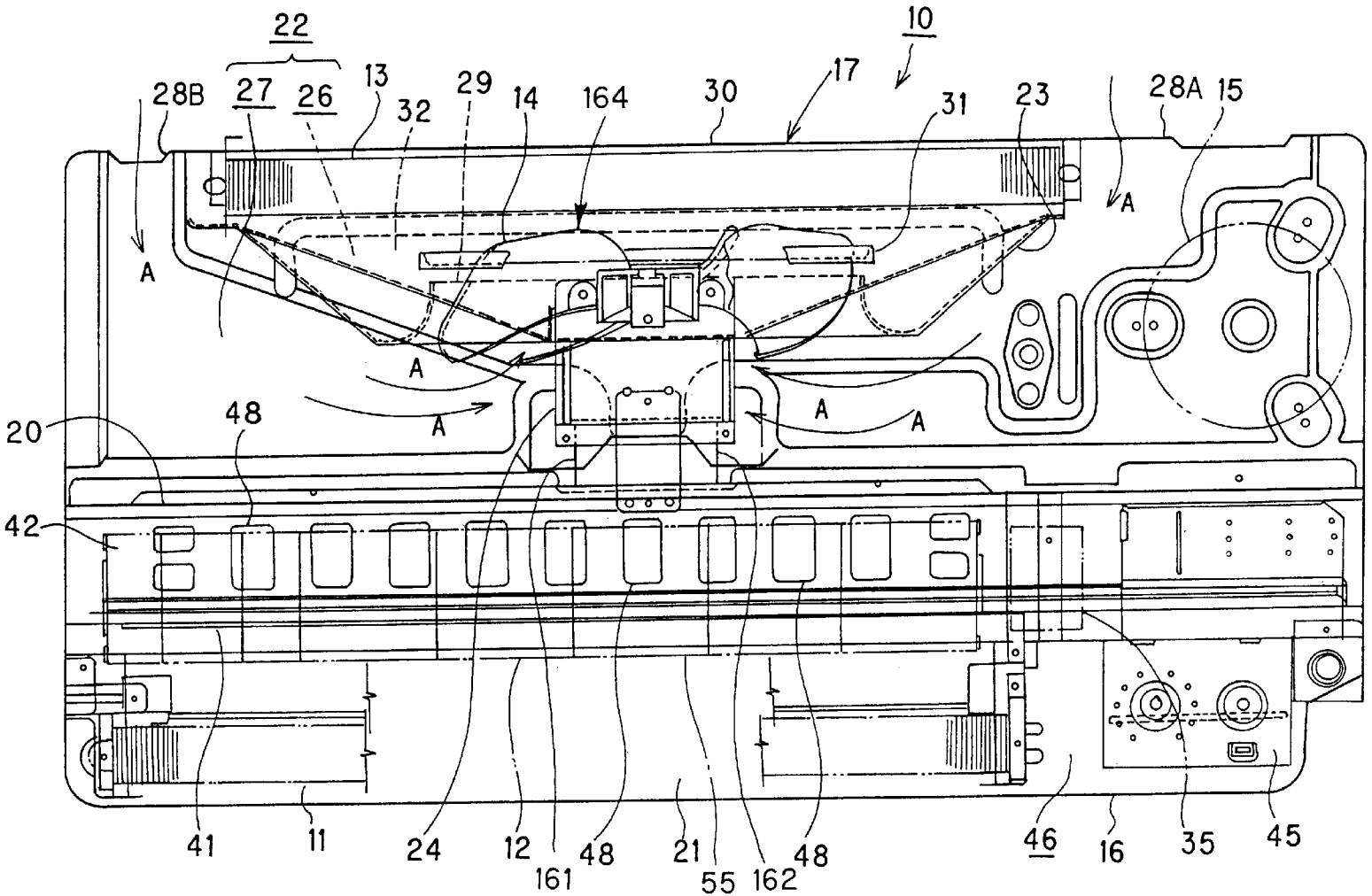
FIG. 4 is a plan view showing the air conditioner shown in FIG. 1 when a cabinet is omitted from the illustration.

As shown in FIGS. 3 and 4, in the air-conditioner main body 17, a partition plate 20 is erectly equipped at the substantially center position in the front and rear direction of the bottom plate 16 so as to extend in the full-width direction of the bottom plate 16. The partition plate 20 compartments the inside of the air-conditioner main body 17 into an indoor-side chamber 21 in which the indoor heat exchanger 11, the cross-flow fan 12, etc. are arranged and an outdoor-side chamber 22 in which the outdoor heat exchanger 13, the propeller fan 14, the compressor 15, etc. are arranged. Accordingly, the front panel 18 disposed at the front side of the air conditioner 10 covers the indoor-side chamber 21, and the cabinet 19 disposed at the rear side of the air conditioner 10 compartment the surrounding of the outdoor-side chamber 22.

The outdoor heat exchanger 13, an outdoor fan casing 23, a support leg 24 and the compressor 15 are disposed at the outdoor-side chamber side on the bottom plate 16.

The compressor 15 is connected to the outdoor heat exchanger 13, a pressure reducing device (not shown) and the indoor heat exchanger in this order through a refrigerant pipe (not shown), thereby constructing a refrigeration cycle. When the air conditioner 10 is under cooling operation, the outdoor heat exchanger 13 functions as a condenser, and the indoor heat exchanger 11 functions as an evaporator. When the air conditioner 10 is under heating operation, the outdoor heat exchanger 13 functions as an evaporator, and the indoor heat exchanger 11 functions as a condenser.

The outdoor fan casing 23 is disposed so as to be connected t the outdoor heat exchanger 13, and the propeller fan 14 is disposed inside the outdoor fan casing 23. The propeller fan 14 is rotated by an outdoor driving motor 25, and the outdoor driving motor 25 is supported on the support leg 24 The outdoor-side chamber 22 is partitioned into an outdoor discharge chamber at the inside of the outdoor fan casing 23 and an outdoor suction chamber 27 at the outside of the outdoor fan casing 23 by the outdoor fan casing 23.

By rotation of the propeller fan 14, the outside air is sucked from the outdoor suction ports 28A, 28B at both the sides of the outdoor heat exchanger 13 into the outdoor suction chamber 27 as shown by arrows A of FIG. 4, passed through the a fan orifice 29 of the outdoor fan casing 23 and then discharged into the outdoor discharge chamber 26. Thereafter, the outside air is passed through the outdoor heat exchanger 13 and then discharged from the outdoor discharge port 30 to the outside. Under the cooling operation of the air conditioner 10, the outdoor heat exchanger 13 discharge heat to the outside air, and under the heating operation of the air conditioner 10, the outdoor heat exchanger 13 takes heat from the outside air.

As shown in FIG. 3, each vane of the propeller fan 14 is equipped with a slinger ring on the outer peripheral portion thereof to link the vanes to one another. Under the cooling operation of the air conditioner 10, drain water occurs on the indoor heat exchanger 11 serving as the evaporator. The drain water is collected in a drain pan 33 as described later, and then it is passed through a drain opening 44 formed at the lower end portion of the partition plate 20 and stocked into a reservoir portion 32 disposed on the bottom plate 16. The slinger ring 31 drains up the drain water stocked in the reservoir portion 32 when the propeller fan 14 is rotated, and the drain water thus drained up is scattered to the outdoor heat exchanger 13 functioning as the condenser, whereby the condensation function of the outdoor heat exchanger is enhanced.

The drain pan 33 is disposed at the indoor-side chamber side on the bottom plate 16, and the indoor heat exchanger 11 is disposed on the drain pan 33. The partition plate 20 is designed in a box-shape having an opening at the indoor-side chamber side, and an indoor fan casing 34 is disposed inside the partition plate 20.

The indoor fan casing 34 is curved from the position corresponding to a first top panel 41 (described later) of the partition plate 20 so as to extend to the drain pan 33, and an electrical heater 55 is disposed at the lower end portion of the indoor fan casing 34 so as to be adjacent to the indoor heat exchanger 11. A cross-flow fan 12 is disposed at the inside of the curved indoor fan casing. Accordingly, the indoor fan casing 34 is disposed between the partition plate 20 and the cross-flow fan 12.

The cross-flow fan 12 is rotated by an indoor driving motor 35 shown in FIG. 4, and the cross-flow fan 12 and the indoor driving motor 35 are supported on the partition plate 20. The indoor fan casing 34 forms an indoor circulating chamber 36 and an outside air introducing chamber 37 at the indoor-side chamber side as shown in FIG. 3. Further, as shown in FIG. 4, an electrical-equipment chamber 46 in which an electrical-equipment ox 45 is accommodated is formed at the indoor-side chamber side.

The indoor heat exchanger 11, the cross-flow fan 12 and the electrical heater 55 are disposed in the indoor circulating chamber 36 as shown in FIG. 3. Further, an air filter 38 and a stabilizer 39 are disposed in the indoor circulating chamber 36. The air filter 38 is disposed between a suction grille 40 formed in a front panel 18 and the indoor heat exchanger 11. The stabilizer 39 is disposed at the upper side of the indoor heat exchanger 11 so as to extend to the cross-flow fan 12. The stabilizer 39 enables the air in the indoor circulating chamber 36 to be excellently sucked into the cross-flow fan 12, and the air thus sucked can be excellently discharged from the cross-flow fan 12. A blow-out grille 43 for guiding the discharged air into the room of the building is formed at the upper side of the suction grille 40 on the front panel 18.

The air in the room of the building is taken from the suction grille 40 into the indoor circulating chamber 36 of the indoor-side chamber 21 by the rotation of the cross-flow fan 12. The air thus taken is passed through the air filter 38, the indoor heat exchanger 11 and the electrical heater 55 in this order, and then sucked into the cross-flow fan 12. Thereafter, the air is discharged from the cross-flow fan 12, and blown out from the blow-out grille 43 into the room. Under the cooling operation of the air conditioner 10, the indoor heat exchanger 11 cools the indoor air taken in the indoor circulating chamber 36 to cool the inside of the room. Under the heating operation, the indoor air is heated to heat the inside of the room.

The outside air introducing chamber 37 is one of constituent elements constituting a ventilation device for taking the outside air from the outdoor-side chamber 22 into the indoor circulating chamber 36 of the indoor-side chamber 21, whereby fresh air can be supplied into the room of the building. The ventilation device 47 is constructed by ventilation ports 48, a ventilation shutter 49 and a ventilation aeration portion 50A in addition to the outside air introducing chamber 37.

Figure 5:
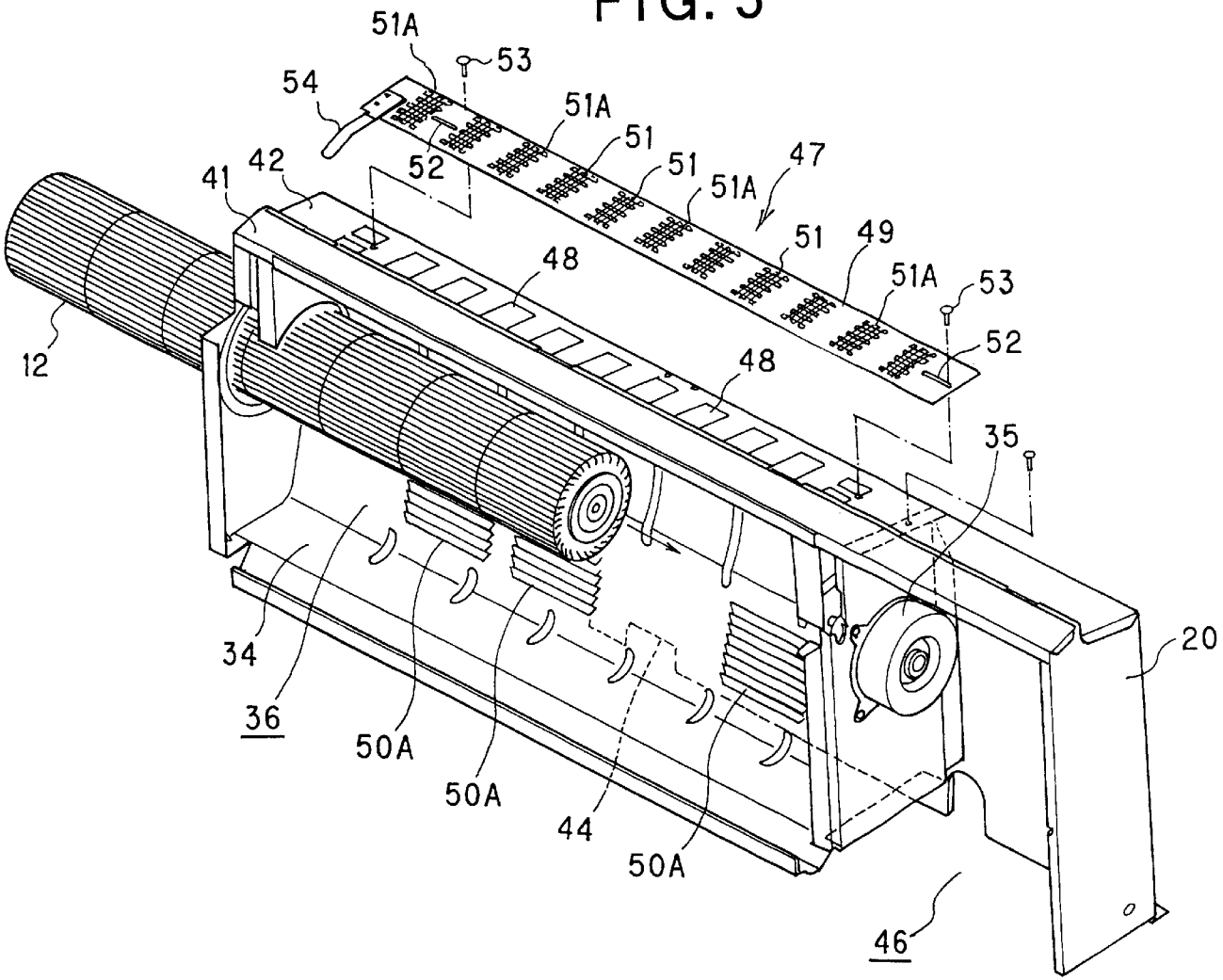
FIG. 5 is an exploded perspective view showing a partition plate, a cross-flow fan, a ventilation device, etc. shown in FIG. 2.

A second top panel 42 is formed at the lower position than the first top panel 41 on the box-shaped partition plate 20 so as to intercommunicate with the first top panel 41. The second top panel 42 is disposed inside the cabinet 19 compartmenting the surrounding of the outdoor-side chamber 22. As shown in FIGS. 4 and 5, a plurality of ventilation ports 48 are formed in the second top panel 42 to be juxtaposed with one another at the same pitch in the longitudinal direction of the second top panel 42.

A ventilation shutter 49 having many fine holes 51 formed therein is mounted on the second top panel 42. These fine holes 51 are gathered every group, and plural fine-hole groups 51A are arranged at the same pitch in the longitudinal direction of the ventilation shutter 49. The pitch of the fine-hole groups 51A is set to substantially the same pitch as the ventilation ports 48 of the second top panel 42.

Elongated holes 52 extending in the longitudinal direction of the ventilation shutter 49 are formed at both the end portions of the ventilation shutter 49. The ventilation shutter 49 is fixed to the second top panel 42 of the partition plate 20 through screws penetrating through the elongated holes 52 so as to be freely slidable in the longitudinal direction of the second top panel 42 and the ventilation shutter 49.

Figure 6:
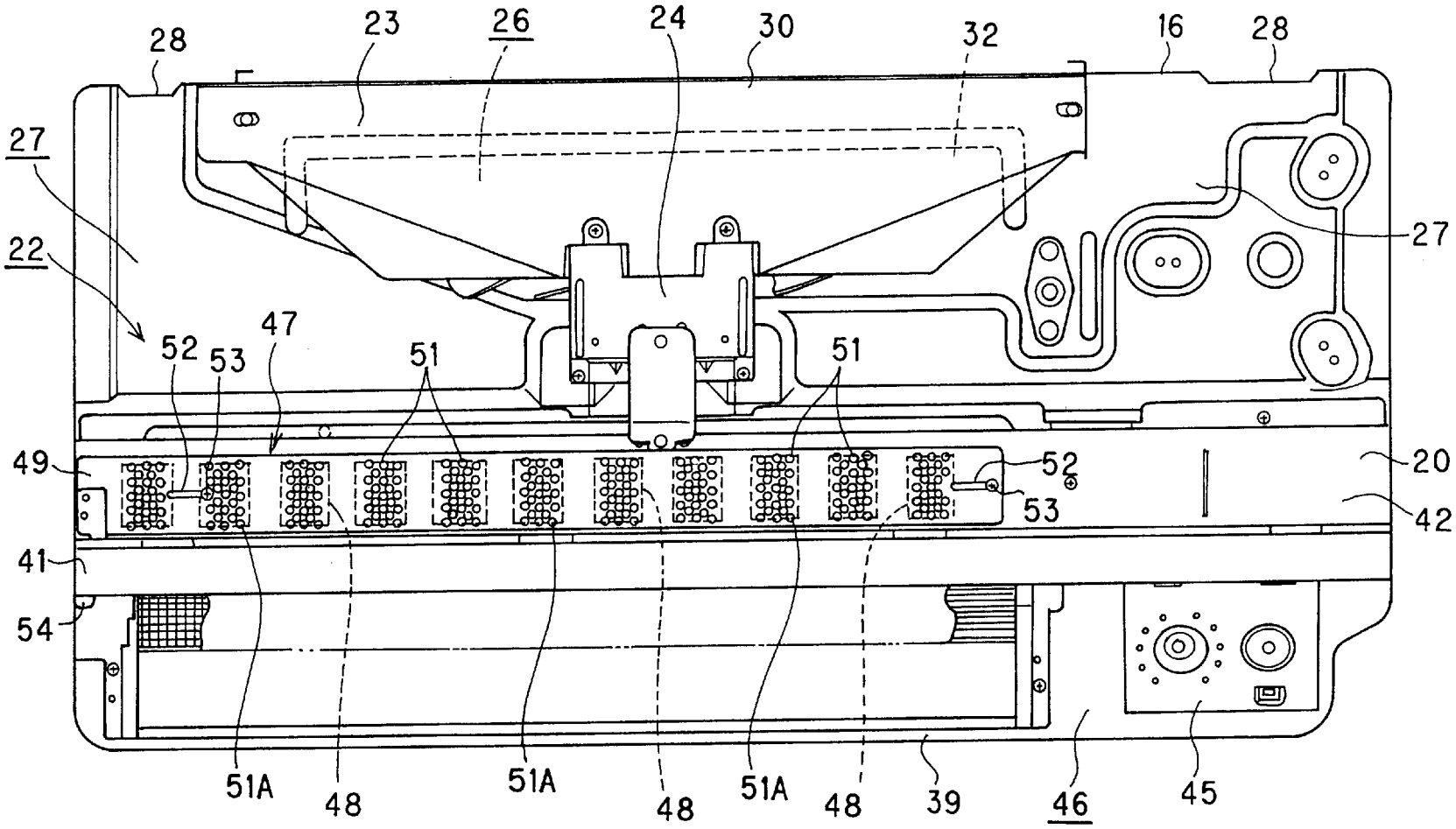
FIG. 6 is a plan view corresponding to FIG. 4 when the ventilation device, etc. are installed.

As shown in FIG. 6, when the fine-hole groups 51A of the ventilation shutter 49 are positionally coincident with the ventilation ports 48 by sliding the ventilation shutter 49, the ventilation ports 48 are fully opened. On the other hand, when the fine-hole groups 51A are not positionally coincident with the ventilation ports 48 and the ventilation shutter 49 closes the ventilation ports 48, the ventilation ports 48 are fully closed. Further, by sliding the ventilation shutter 49 to any position between the full-open position and the full-close position, the opening degree of the ventilation ports 48 can be freely adjusted to any intermediate value between the full-open value and the full-close value, such as a half-open value, a second-thirds open value or the like. Through the opening operation of the ventilation ports 48, the outside air flowing into the outdoor-side chamber 22 is guided by the cabinet 19 to pass through the fine holes 51 of the ventilation shutter 49 and the ventilation ports 48 of the second top panel 42, and then introduced into the outside introducing chamber 37.

Here, the ventilation ports 48 are designed to be inclined downwardly to the outdoor-side chamber 22, whereby the fluid flow area of the outside air between the second top panel 42 and the cabinet 19 is more greatly enlarged as compared with the case where the ventilation ports 48 are designed to be horizontal. Further, each of the fine holes 51 of the ventilation shutter shown in FIG. 6 is formed to have a remarkably smaller diameter than the opening area of the ventilation ports 48, whereby the diameter of each fine hole 51 is set to such a value that it functions as an air filter to prevent invasion of insects, dust, etc.

The ventilation aeration portion 50A is equipped with plural vent ports 50 at the lower portion of the indoor fan casing 34 as shown in FIG. 5. The vent ports 50 are formed in a louver-shape so as to be juxtaposed with one another by cutting the lower portion of the indoor fan casing 34 into plural pieces and erecting the pieces thus achieved as shown in FIG. 5. A plurality of ventilation aeration portions 50A as described above are formed in the longitudinal direction of the indoor fan casing 34 except for the position corresponding to the drain opening 44 of the partition plate 20.

When the cross-flow fan 12 is rotated, the space below the cross-flow fan 12 in the indoor circulating chamber 36, that is, the space in the neighborhood of the ventilation aeration portions 50A is kept under negative pressure as shown in FIG. 3. Therefore, as indicated by arrows C of FIG. 3, the outside air introduced through the fine holes 51 of the ventilation shutter 49 and the ventilation ports 48 of the second top panel 42 into the outside air introducing chamber 37 downwardly flows along the outside of the curved indoor fan casing 34, passes through the aeration ports 50 of the plural ventilation aeration portions 50A and then is guided into the indoor circulating chamber 36. The outside air thus guided into the indoor circulating chamber 36 is mixed with the indoor air air-conditioned by the indoor heat exchanger 11, and introduced from the blow-out grille 43 of the front panel 18 into the room of the building, whereby fresh air is supplied into the room.

As shown in FIG. 5, an operating lever 54 is integrally linked to one end portion of the ventilation shutter 49. The operating lever 54 is disposed so as to extend to the indoor heat exchanger 11 as shown in FIGS. 2 and 6 so that it can be manipulated when the front panel 18 is detached from the main body of the air conditioner or the like. By manipulating the operating lever horizontally, the ventilation shutter 40 is directly slid to any position with no wire, whereby the opening degree of the ventilation ports 48 can be adjusted to any value such as the full-open value, the full-close value, the half-open value, etc.

According to the air conditioner of the above-described embodiment, the ventilation can be excellently performed with a simple construction.

In the above embodiment, the ventilation shutter 49 of the ventilation device 47 is designed to be freely slidable. However, the ventilation shutter 49 may be fixed to the second top panel 42 of the partition 20 by screws or the like after the opening degree of the ventilation ports 48 is determined by the ventilation shutter 49.

In the above-described air conditioner, the electric heater 55 disposed in the vicinity of the indoor heat exchanger 11 heats the indoor air which is sucked from the suction grille 40 by rotation of the cross-flow fan 12, and blows out the indoor air thus heated as shown in FIG. 3, thereby heating the room.

Figure 8:
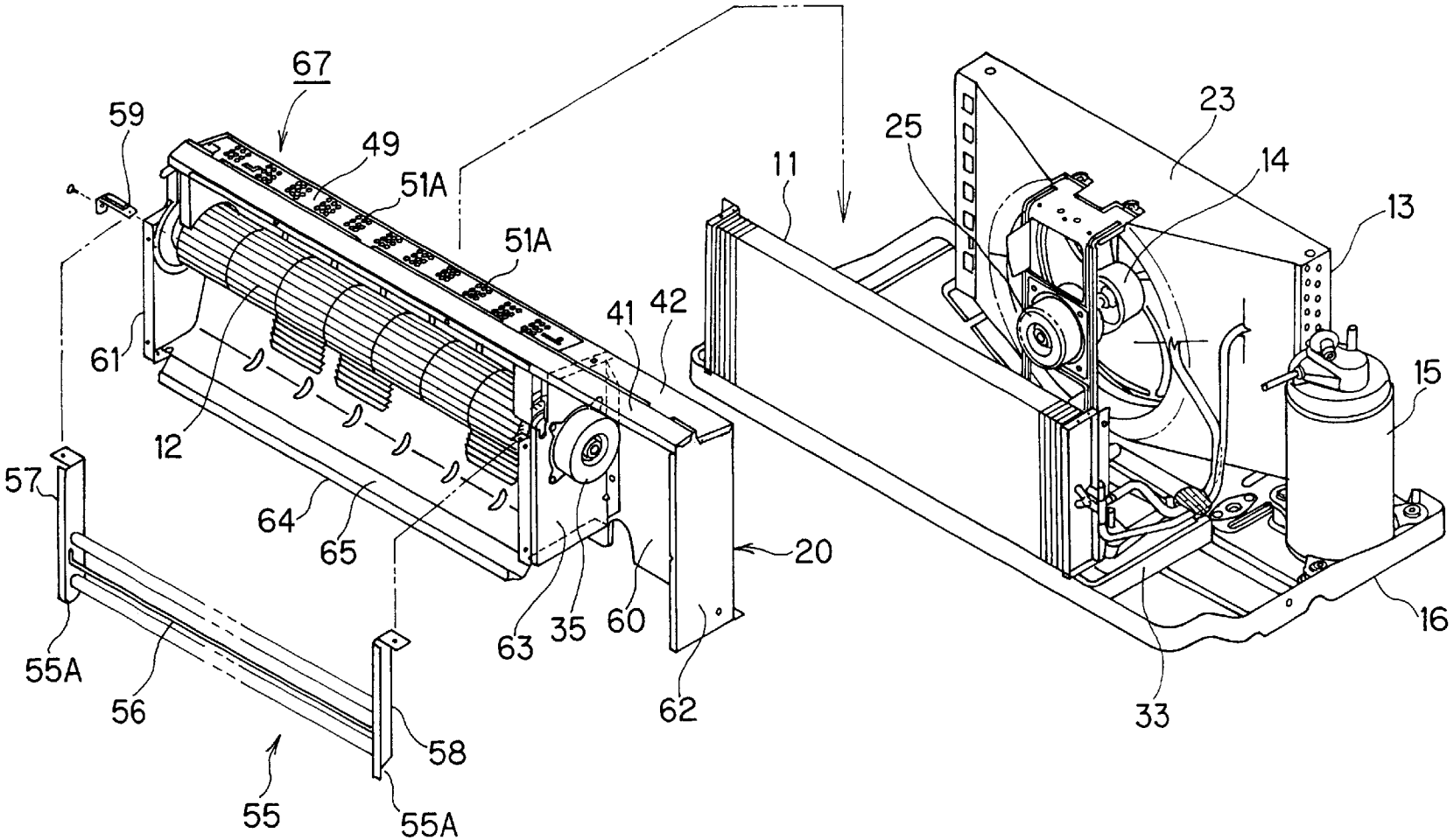
FIG. 8 is an exploded perspective view showing the assembly of the parts of the air conditioner shown in FIG. 1.

The electrical heater 55 may be constructed by bridging one or plural heater wires between heater brackets 57 and 58 as shown in FIG. 8. In this case, by supplying current to the heater wire(s) 56, the heater wire(s) generate Joule heat and heats the air. The heater bracket 57 is fixed to one side face 61 of the partition plate 20 through a fixing bracket 59 by a screw or the like.

The partition plate 20 is designed in such a substantially box-shape so that the first top panel 41 and the second top panel 42 are connected to the upper side of a main panel 60 through which the indoor-side chamber 21 and the outdoor-side chamber 22 are compartmented, one side panel 61 is connected to one side of the main panel 60 and the other side panel 62 is connected to the other side of the main panel 60. Further, an intermediate panel 63 is fixed to the main panel 62 between the one side panel 61 and the other side panel 62. The indoor driving motor 35 disposed at the other end side of the cross-flow fan 12 is fixed to the intermediate panel 63, one end side of the cross-flow fan 12 is fixed to one side panel 61, and the cross-flow fan 12 and the indoor driving motor 35 are supported on the partition plate 35.

The electrical heater 55 is supported on the partition plate 20 by fixing the heater bracket 57 to one side panel 61 of the partition plate 2 through the fixing bracket 59 as described above and fixing the heater bracket 58 to the intermediate panel 63 with a screw or the like. Under the condition that the electrical heater is assembled, the electrical heater 55 is located above the drain pan 33 as shown in FIG. 3, and the lower portion, that is, the lower end portion 55A of the electrical heater 55 is mounted in a heater lower-end portion mount portion 64 of the indoor fan casing 34.

As described above, the indoor fan casing 34 guides the stream of the air generated by the rotation of the cross-flow fan 12 so that the air successively flows through the suction grille 40, the air filter 38, the indoor heat exchanger 11, the electrical heater 55, the cross-flow fan 12 and the blow-out grille 43 in this order. As shown in FIGS. 3 and 5, the heater lower-portion mount portion 64 is integrally formed with the lower end portion of the indoor fan casing 34 extending to the drain pan 33 by bend-shaping or the like. The lower end portion 55A of the electrical heater 55 is mounted in the heater lower-portion mount portion 64 so as to be wholly covered by the heater lower-portion mount portion 64. Accordingly, the radiation heat of Joule heat generated by the electrical heater is intercepted by the heater lower-portion mount portion, and thus it is prevented from being transmitted to the drain pan 33 which is formed of foamed polystyrene, for example.

Figure 9:
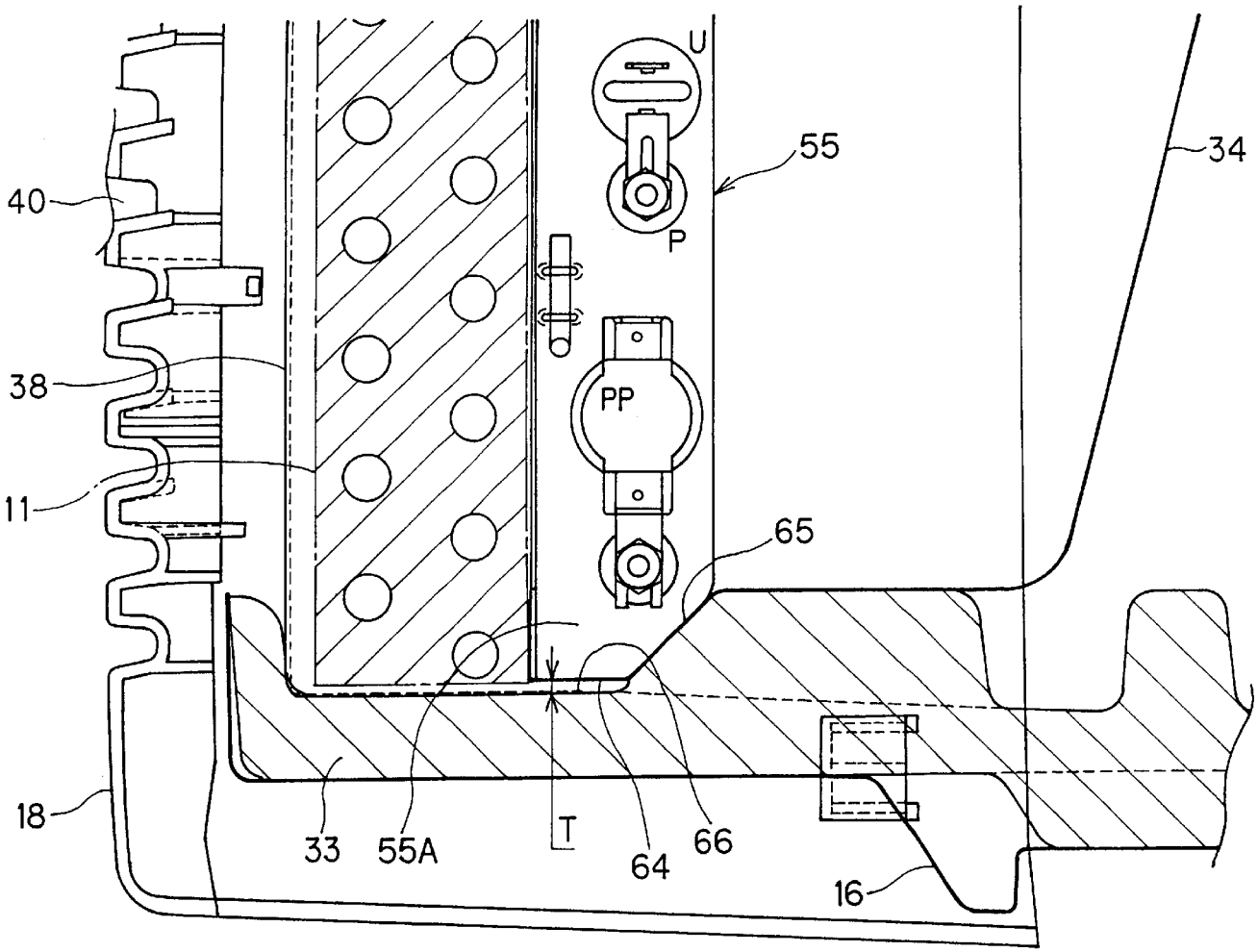
FIG. 9 is a cross-sectional view showing the arrangement of an electrical heater on a heater lower-portion mounting portion of an indoor fan casing.

The lower end portion of each of the heater brackets 57 and 58 of the electrical heater 55 is tapered. Accordingly, the heater lower-portion mount portion 64 in which the lower end portions of the heater brackets 57 and 58 are mounted is designed to have a tapered guide face 65 which is upwardly gradually enlarged in cross-sectional area from the lower side to the upper side in the mount portion as shown in FIG. 9. When the electrical heater 55 is lifted down from the upper side while suspended to install the electrical heater 55 in the air conditioner, the lower end portions of the heater brackets 57 and 58 abut against the guide face 65 and is guided along the guide face 65, whereby the positioning of the electrical heater 55 can be quickly performed.

As shown in FIG. 9, the drain pan 33 has a recess portion 66 formed at the position where the heater lower-portion mount portion 64 of the indoor fan casing 34 is located. The recess portion 66 is designed to have the shape corresponding to the heater lower-portion mount portion 64. Formation of the recess portion 66 in the drain pan 33 brings a gap T between the recess portion 66 of the drain pan 33 and the heater lower-portion mount portion 64 in which the lower end portion 55A of the electrical heater 55 is mounted under the condition that the electrical heater 55 is installed. Existence of the gap T enables the drain water generated by the indoor heat exchanger 11 to flow along the surface of the drain pan 33 in the gap T.

Next, the installing process of the electrical heater 55 will be described hereunder.

Figure 7:
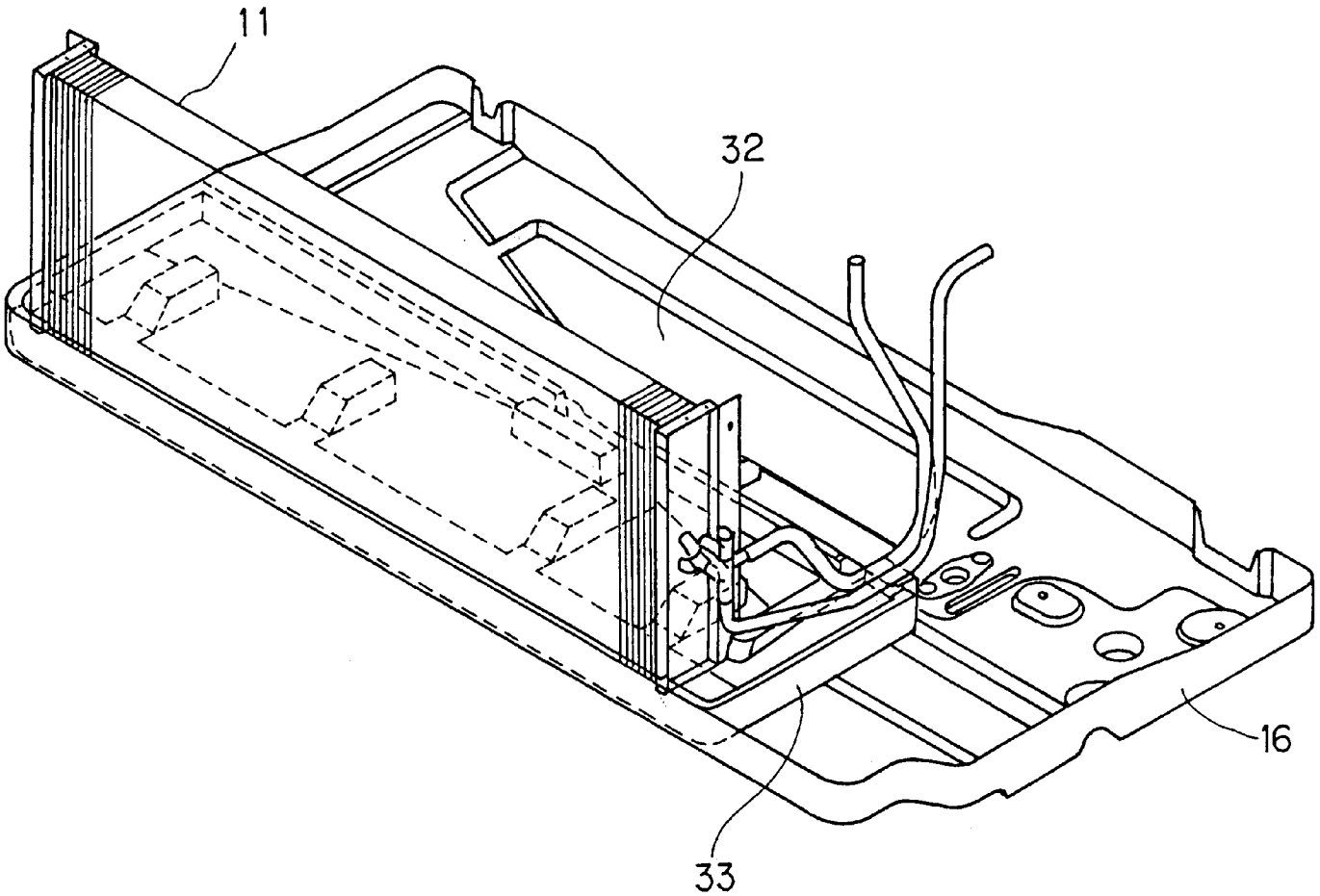
FIG. 7 is a perspective view showing the arrangement of an indoor heat exchanger and a drain pan on a bottom plate.

First, as shown in FIG. 7, the drain pan 33 is first mounted on the bottom plate 16 and the indoor heat exchanger 11 is disposed on the drain pan 33.

In parallel to the above step or after or before the above step, as shown in FIG. 5, the cross-flow fan 12 is disposed in the partition plate 20 and the ventilation shutter 49 is fixed to thereby fabricate a partition plate unit 67 as shown in FIG. 8. Subsequently, the partition plate unit 67 is mounted on the bottom plate 16.

Thereafter, as shown in FIG. 3, the electric heater 55 is lifted down from the upper side while suspended, and the lower end portion 55A is guided along the guide surface of the heater lower-portion mount portion 64 of the indoor fan casing 34 to position the electrical heater 55. Subsequently, the heater brackets 57, 58 of the electrical heater 55 are fixed to the one side panel 61 and the intermediate panel 63 of the partition plate 20 to thereby complete the installation of the electrical heater 55.

The present invention is not limited to the above-described embodiment. For example, a guide face having a curved shape which is upwardly enlarged may be formed on the heater lower-portion mount portion 64 of the drain pan 33 in place of the upwardly enlarged tapered guide face 65.

As described above, according to the above-described embodiment, the installation of the electrical heater can be enhanced.

In the above-described air conditioner, the propeller fan 14 serving as the outdoor fan shown in FIGS. 3 and 4 may be a type of axial fan, and it is rotated by the outdoor driving motor 25 mounted on the support leg 24 serving as a support member. The propeller fan 14, the support leg 24 and the outdoor driving motor 25 constitute an outdoor fan device 164 serving as an axial fan device. The support leg 24 is disposed at the suction side of the propeller fan 14, that is, it is disposed in the outdoor suction chamber 27.

As described above, the outdoor-side chamber 22 is partitioned into the outdoor suction chamber 27 and the outdoor discharge chamber 26 by the outdoor fan casing 23, and the propeller fan 14 and the outdoor heat exchanger 13 are disposed in the outdoor discharge chamber 26. The air sucked by the propeller 14 is discharge to the outdoor heat exchanger 13.

Figure 10:
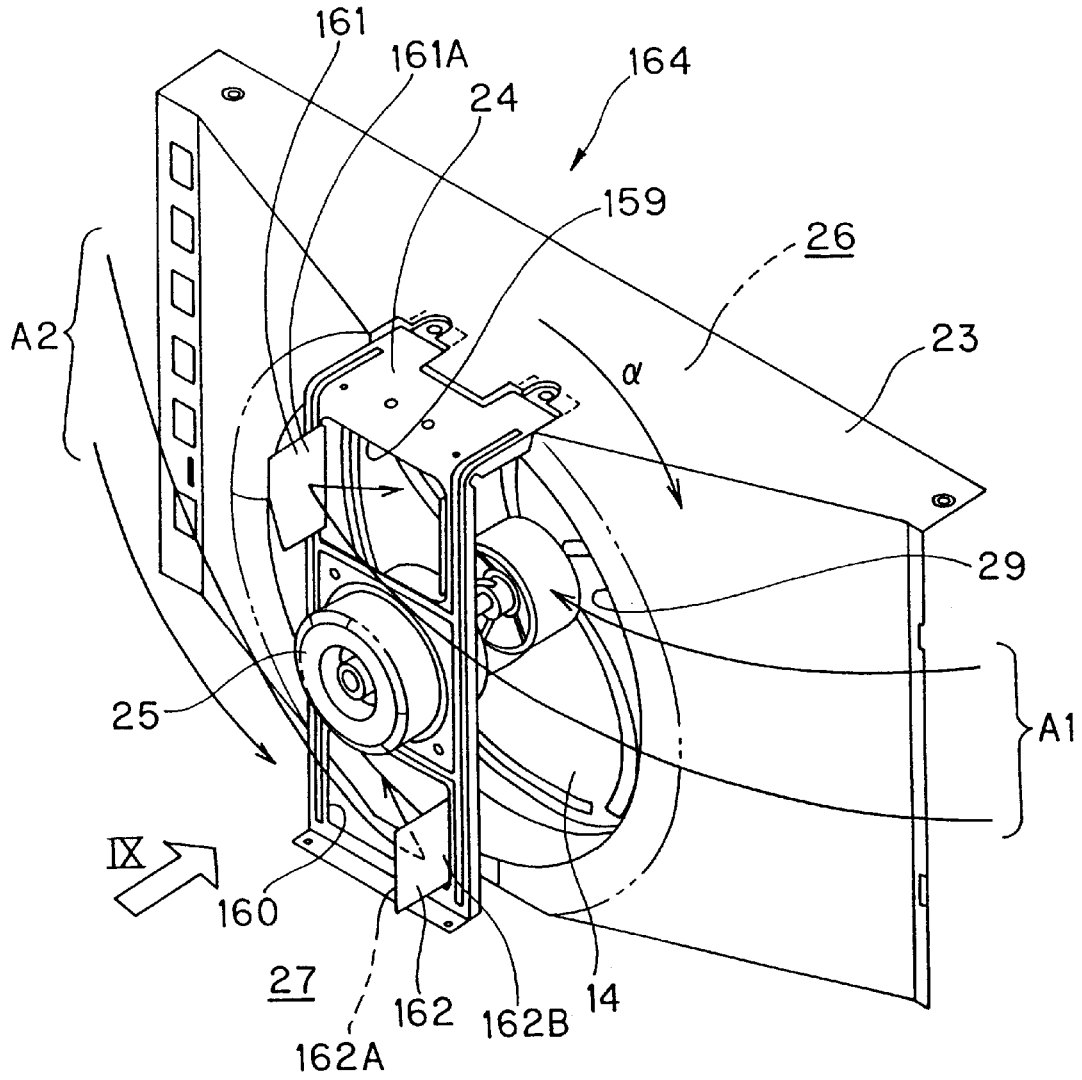
FIG. 10 is a perspective view showing an outdoor fan device.
Figure 11:
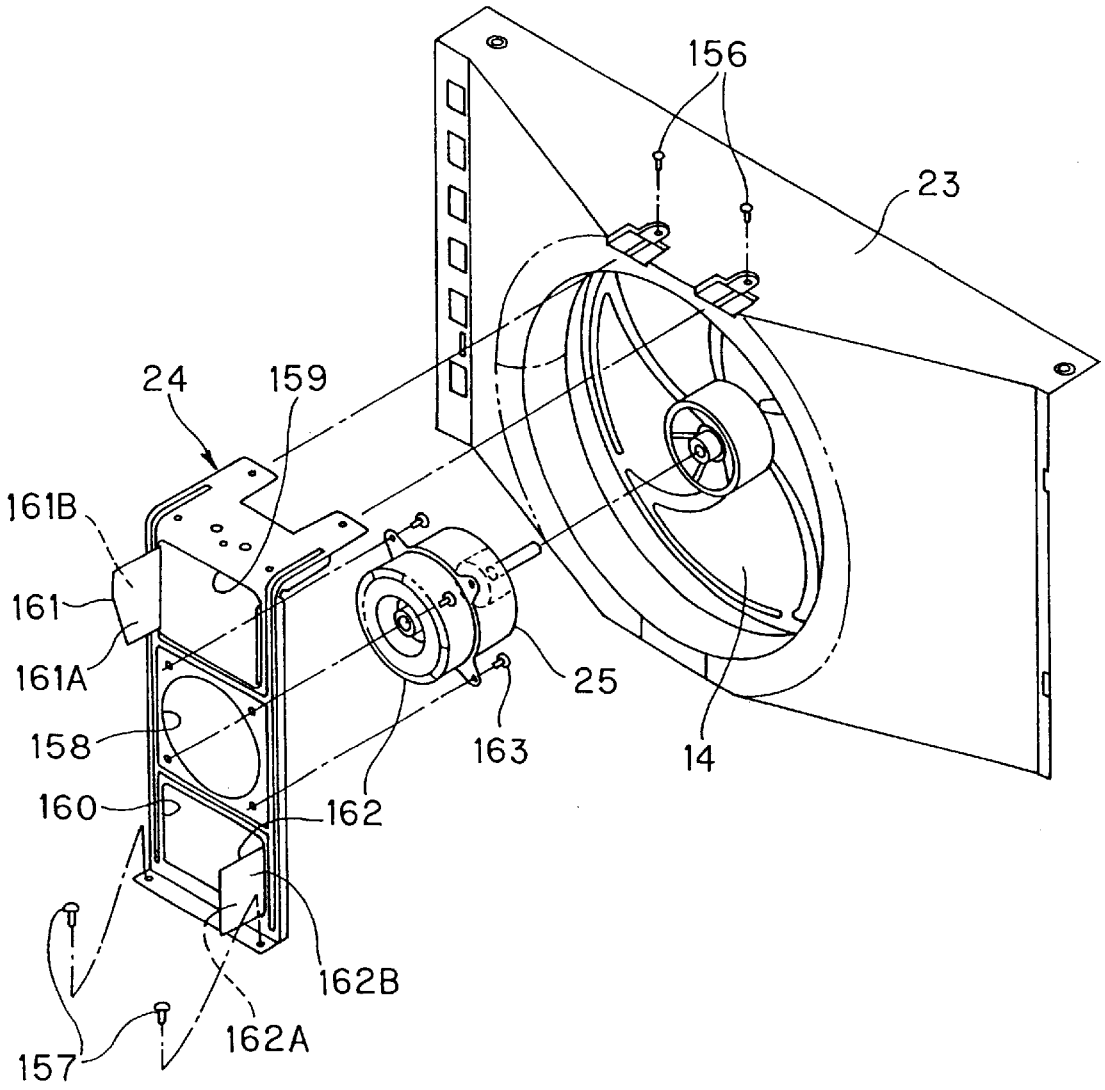
FIG. 11 is an exploded perspective view showing the outdoor fan device shown in FIG. 10.

As shown in FIGS. 10 and 11, the upper end portion of the support leg 24 is fixed to the outdoor fan casing 23 by using screws 156, and the lower end portion of the support leg 24 is fixed to the bottom plate 16 by using screws 157. Further, the support leg 24 has a motor fixing hole 158 at the center thereof, an upper air hole 159 at the upper portion thereof and a lower air hole 160 at the lower portion thereof. In addition, the support leg 24 is equipped with an upper guide plate 161 and a lower guide plate 162 serving as guide members so that the upper and lower guide plates 161 and 162 are adjacent to the upper air hole 59 and the lower air hole 160, respectively.

The support leg 24 having the motor fixing hole 58, the lower air hole 60, the upper guide plate 61 and the lower guide plate 62 is integrally formed by punching working and press working. The upper guide plate 61 and the lower guide plate 62 are disposed so as to be adjacent to the upper air hole 59 and the lower air hole 60 respectively, and also they are located at the downstream side of the air which flows at the back side of the outdoor fan casing 23 and the propeller fan 14 and at the outside of the support leg 24 (the upper guide plate 161 is disposed at the downstream side (left side) of the air flowing as indicated by arrows A1 shown in FIG. 12, and the lower guide plate 162 is disposed at the downstream side (right side) of the air flowing as indicated by arrows A2 shown in FIG. 12).

A part of the outdoor driving motor 25 is inserted in the motor fixing hole 158, and the outdoor driving motor 25 is fixed to the support leg 24 by screws 163, whereby the outdoor driving motor 25 is fixedly mounted on the support leg 24.

Figure 12:
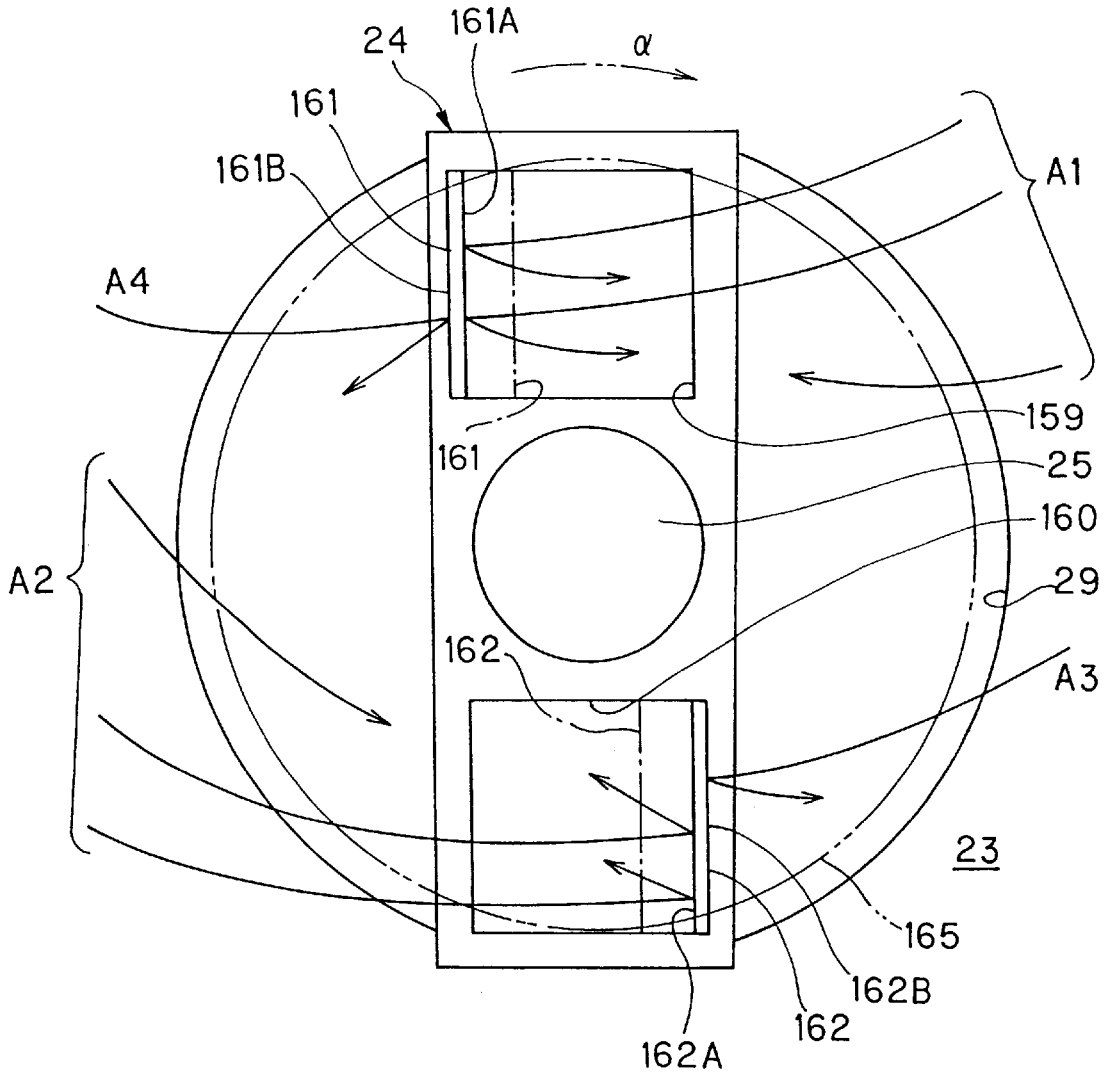
FIG. 12 is a front view taken in a direction of an arrow IX.

The upper air hole 159 and the lower air hole 160 serve to guide to the propeller fan 14 the air at the outside of the support leg 24 in the outdoor suction chamber 27. As shown in FIGS. 10 and 12, the upper guide plate 161 and the lower guide plate 162 have a first function of collecting the air flowing at the outside of the support leg 24 in the outdoor suction chamber 27 and guiding the air thus collected through the upper air hole 159 and the lower air hole 160 to the propeller fan 14, and a second function described later.

That is, when viewed from the back side of the propeller fan 14, in a case where the air in the outdoor suction chamber 27 is sucked by rotation of the propeller fan 14 in the right direction (the direction of an arrow $\alpha$ of FIGS. 10 and 12) and discharged to the outdoor heat exchanger 13 as indicated by the arrows A of FIG. 4, the air sucked from the outdoor suction port 28A at the right side of FIG. 4 mainly flows to an upper half portion of the propeller fan 14 at the back side of the outdoor fan casing 23 and the propeller fan 14 as indicated by the arrows A1 of FIGS. 10 and 12. In this case, a part of the air flows through the fan orifice 29 of the outdoor fan casing 23 and is directly sucked into the propeller fan 14, and the other part of the air flows along the outside of the support leg 24, and is collected by the inner surface 161A of the upper guide plate 161 and then sucked through the upper air hole 159 into the propeller fan 14 (the first function of the upper guide plate 161). On the other hand, the air sucked from the outdoor suction port 28B at the left side of FIG. 4 mainly flows to the lower half portion of the propeller fan 14 at the back side of the outdoor fan casing 23 and the propeller fan 14. In this case, a part of the air flows through the fan orifice 29 and is directly ducked into the propeller fan 14. The other part of the air flows along the outside of the support leg 24, and is collected by the inner surface 162A of the lower guide plate 162 and then sucked through the lower air hole 160 into the propeller fan 14 (the first function of the lower guide plate 62).

By the first function of the upper and lower guide plates 161 and 162, the capture rate of the air flowing at the back side of the outdoor fan casing 23 and the propeller fan 14 by the propeller fan 14 is enhanced. Accordingly, even when the same level input electrical energy is applied to the outdoor driving motor for rotating the propeller fan 14, the air blowing amount of the propeller fan 14 can be increased by about 5% as compared with the case where the upper guide plate 161 and the lower guide plate 162 are not equipped.

Further, a part of the air sucked from the outdoor suction port 28A at the right side of FIG. 4 may flow to the lower half portion of the propeller fan 14 at the back side of the outdoor fan casing 23 and the propeller fan 14 as indicated by an arrow A3 of FIG. 12. The air thus flowing collides against the outer surface 162B of the lower guide plate 162, and the collision between the air flowing in the direction of the arrow A3 and the air flowing in the direction of the arrows A2 can be suppressed (the second function of the lower guide plate 162).

On the other hand, a part of the air sucked from the outdoor suction port 28B at the left side of FIG. 4 may flow to the upper half portion of the propeller fan 14 at the back side of the outdoor fan casing 23 and the propeller fan 14 as indicated by an arrow A4 of FIG. 12. The air thus flowing collides against the outer surface 161B of the upper guide plate 161, and the collision between the between the air flowing in the direction of the arrow A4 and the air flowing in the direction of the arrows A1 can be suppressed (the second function of the upper guide plate 161).

By the second function of the upper guide plate 161 and the lower guide plate 162, disturbance of the air flowing at the outside of the support leg 24 is reduced and the air flow is rectified, so that the air suction and discharge ambient noise (air blowing noise) by the propeller fan 14 can be reduced.

As shown in FIG. 12, the whole or a part of each of the upper and lower guide plates 161 and 162 is disposed within the outer peripheral edge 65 of the propeller fan 14. Therefore, after the upper guide plate 161 and the lower guide plate 162 capture the air flowing at the outside of the support leg 24, they can surely guide the air to the propeller fan 14.

Further, the upper guide plate 161 and the lower guide plate 162 are disposed to be substantially perpendicular to the flowing direction of the air flowing at the outside of the support leg 24 (the direction of the arrow A1 in the case of the upper guide plate 161, and the direction of the arrow A2 in the case of the lower guide plate 162, or disposed to be inclined in a direction confronting the air flowing direction as indicated by a one-dotted chain line of FIG. 12. Accordingly, the air capturing rate of the upper and lower guide plates 161 and 162 is enhanced.

In the embodiment, the upper guide plate 161 and the lower guide plate 162 formed on the support leg 24 may be formed to extend from the support leg 24 to a position close to the propeller fan 14.

Figure 13:
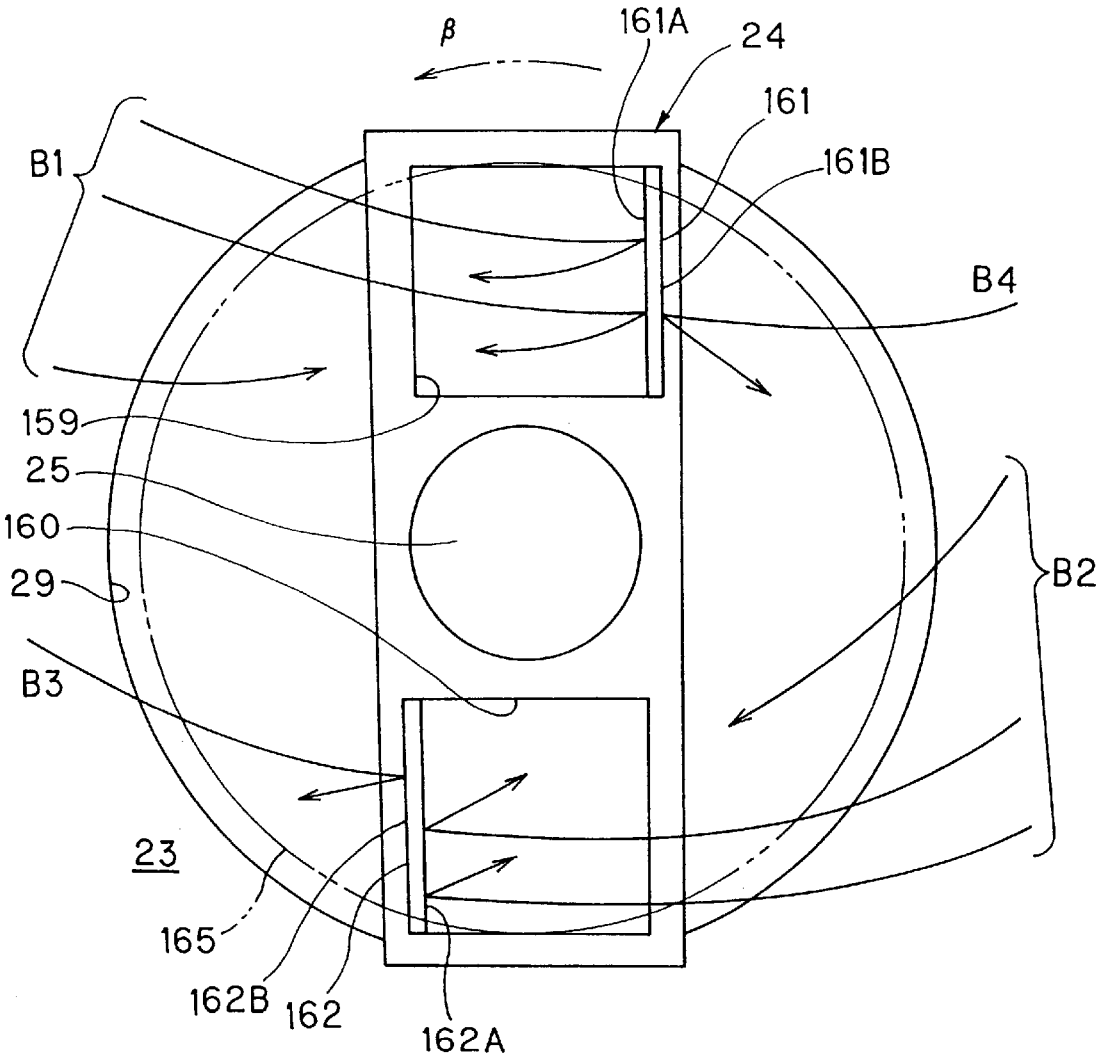
FIG. 13 is a front view taken in the direction of the arrow IX when the rotational direction of a propeller fan is opposite to that of FIG. 12.

Further, in the above embodiment, the air at the back side of the outdoor fan casing 23 and the propeller fan 14 is sucked into the propeller fan 14 through the rotation of the propeller fan 14 in the direction of the arrow α shown in FIGS. 10 and 12. However, the present invention may be applied to a case where the angles of the vanes of the propeller 14 are changed to make it possible to suck the air at the back side of the outdoor fan casing 23 and the propeller fan 14 into the propeller 14 through the rotation of the propeller fan 14 in the opposite direction (the direction of an arrow β of FIG. 10) to the direction of the arrow α. In this case, the directions (arrows A1, A2, A3, A4) of the air flowing at the back side of the outdoor fan casing 23 and the propeller fan 14 are changed to the respective opposite directions (arrows B1, B2, B3, B4). Therefore, as shown in FIG. 13, the upper guide plate 161 is disposed to be adjacent to the right side of the upper air hole 159, and the lower guide plate 162 is disposed to be adjacent to the left side of the lower air hole 160.

Further, in the above-described embodiment, the axial fan device is an outdoor fan device 64 of an air conditioner 10. However, the present invention may be applied to other types of devices each having an axial fan such as a propeller fan or the like, for example, an exhaust fan or the like.

In the above-described embodiment, two guide plates 161, 162 are equipped to the support leg 24. However, the number of guide plates is not limited to two, and it may be set to any number of three or more insofar as the guide plates have the first and second functions.

According to the axial fan device described above and the air conditioner having the axial fan device, the fan discharge amount can be increased.

As described above, according to the present invention, the following effects (1) to (17) can be achieved.

(1) The ventilation shutter 49 that is freely slidably mounted on the second top panel 42 of the partition plate opens/closes the ventilation ports 48 formed in the second top panel 42 to adjust the opening degree of the ventilation ports 48, and introduces the outside air flowing into the outdoor-side chamber 22 into the indoor-side chamber 21 through the ventilation ports 48 whose opening degree is determined (that is, the flow amount of the outside air to be introduced into the indoor-side chamber is adjusted). Therefore, the construction can be simplified and the number of parts can be reduced as compared with the conventional case where the ventilation port of the partition plate is opened/closed by the ventilation door using the hinge.

(2) The opening degree of the ventilation ports 48 in the second top panel 42 of the partition plate 20 can be adjusted by controlling the sliding position of the ventilation shutter 49. Therefore, the ventilation amount of the outside air through the ventilation ports 48 can be freely controlled.

(3) The surrounding of the outdoor-side chamber 22 is compartmented by the sleeve-shaped cabinet 19, and the second top panel 42 of the outdoor-side chamber 22 is disposed inside the cabinet 19, so that the outside air flows through the outdoor-side chamber 22 in the cabinet 19, and is guided and introduced into the ventilation ports 48 of the partition plate 20 by the cabinet 19. Therefore, the ventilation through the ventilation ports 48 can be excellently performed by existence of the cabinet 19.

(4) The second top panel 42 of the partition plate 20 is designed to be downwardly inclined to the outdoor-side chamber (22) side, and thus the fluid flow area of the outside air flowing through the ventilation ports 48 of the second top panel 42 of the partition plate 20 can be increased, so that the ventilation through the ventilation ports 48 can be excellently performed.

(5) The indoor fan casing 34 is disposed between the partition plate 20 and the cross-flow fan 12 in the indoor-side chamber 21, the ventilation aeration portions 50A are formed at the lower portion of the indoor fan casing 34, and the outside air introduced from the ventilation ports 48 of the partition plate 20 into the outside air introducing chamber 37 of the indoor-side chamber 21 is guided through the aeration ports 50 of the ventilation aeration portions 50A into the indoor circulating chamber 36 in which the cross-flow fan 12 is disposed. Therefore, even when strong wind and rain (the weather such as hurricane or the like are introduced from the ventilation ports 48 of the partition plate 20 into the outside air introducing chamber 37 of the indoor-side chamber 21, water droplets of rain collide against the surface at the outside air introducing chamber (37) side of the indoor fan casing 34 and fall down. Therefore, the rain water droplets can be prevented from invading through the ventilation aeration portions 50A of the indoor fan casing 34 into the indoor circulating chamber (36) side of the indoor fan casing 34, and thus invasion of rain into the room can be prevented.

(6) When the wet outside air is passed through the opened ventilation ports 48 and introduced into the indoor-side chamber 21 under the condition that the cross-flow fan 12, etc. are cooled under cooling operation, moisture in the outside air collides against the surface at the outside air introducing chamber (37) side of the indoor fan casing 34 and falls down, so that the outside air from which the moisture is removed is passed through the aeration ports 50 of the ventilation aeration portions 50A of the indoor fan casing 34 and then introduced into the indoor circulating chamber 36 of the indoor-side chamber 21. Therefore, there can be prevented such a phenomenon that the moisture in the outside air is attached and condensed onto the cross-flow fan 12 and the surface at the indoor circulating chamber (36) side of the indoor fan casing 34 which are kept under a low temperature, so that dew thus occurring can be prevented from scattering into the room.

(7) A large number of fine holes that are smaller in diameter than the opening area of the ventilation ports 48 of the partition plate 20 are formed in the ventilation shutter 49, and these fine holes of the ventilation shutter 49 can function as filters. Therefore, for example, it is unnecessary to separately provide an insect screening net or the like to prevent invasion of insects, so that the number of parts can be further reduced.

(8) The operating lever 54 is disposed on the ventilation shutter 49 so as to extend to the indoor heat exchanger 11. Therefore, a user can manipulate the operating lever 54 in the room to slide the ventilation shutter 49 and adjust the opening degree of the ventilation ports 48, so that the operability of the ventilation can be enhanced.

(9) The indoor fan casing 34 is equipped with the heater lower-portion mount portion 64 in which the lower end portion 55A of the electrical heater 55 can be mounted. Therefore, even if any positional displacement occurs in the electrical heater 55 when the electrical heater 55 is installed, the lower end portion 55A of the electrical heater 55 can be mounted in the heater lower-portion mount portion 64, so that the positioning of the electrical heater 55 can be performed and thus the installation performance of the electrical heater 55 can be enhanced.

(10) The heater lower-portion mount portion 64 is equipped with the tapered guide face 65 which is upwardly enlarged in cross-sectional area from the lower side to the upper side. Therefore, when the electrical heater 55 is installed, the lower end portion 55A of the electrical heater 55 can be smoothly mounted in the heater lower-portion mount portion 64 by moving the lower end portion 55A of the electrical heater 55 along the guide face 65. Accordingly, the positioning of the electrical heater 55 can be quickly performed, and the installation of the electrical heater 55 can be enhanced.

(11) The heater lower-portion mount portion 64 of the indoor fan casing 34 is designed so that the lower end portion 55A of the electrical heater 55 can be wholly covered and mounted in the heater lower-portion mount portion 64. Therefore, the radiation heat from the electrical heater 55 can be intercepted by the heater lower-portion mount portion 64, and it can be prevented from being directly transmitted to the drain pan 33. Therefore, the recess portion 66 of the drain pan 33, which is formed of formed polystyrene for example, can be prevented from being thermally deformed by the radiation heat of the electrical heater 55.

(12) The recess portion 66 is formed at the position corresponding to the heater lower-portion mount portion 64 of the drain pan 33, and the heater lower-portion mount portion 654 of the indoor fan casing 34 is disposed so that the gap T is kept between the heater lower-portion mount portion 64 and the recess portion 66 of the drain pan 33. Therefore, the drain water occurring on the indoor heat exchanger 11 can flow through the gap T on the drain pan 33, and thus the flow of the drain water can be smoothened.

(13) The support leg 24 located at the suction side of the propeller fan 14 is equipped with the upper guide plate 161 and the lower guide plate 162 for guiding the air flowing at the outside of the support leg 24 to the propeller fan 14. Accordingly, the capturing rate of the air flowing at the outside of the support leg 24 is enhanced by the action of the upper guide plate 161 and the lower guide plate 162, and the air can be smoothly sucked into the propeller fan 14. Therefore, even when the same input electrical energy is applied to the outdoor driving motor 25, the air blowing amount by the propeller fan 14 can be increased by about 5%, for example.

(14) Since the air flowing at the outside of the support leg 24 can be rectified by the action of the upper guide plate 161 and the lower guide plate 162, the ambient noise (air blowing noise) when the air is sucked and discharged by the propeller 14 can be reduced.

(15) The upper guide plate 161 and the lower guide plate 162 are integrally formed with the support leg 24 for supporting the outdoor driving motor 25 by punching working and press working, so that the upper guide plate 161 and the lower guide plate 162 can be remarkably easily formed.

(16) The whole or a part of each of the upper guide plate 161 and the lower guide plate 162 is disposed within the outer peripheral edge 165 of the propeller fan 14, so that the upper and lower guide plates 161 and 162 can surely guide the air flowing at the suction side of the propeller fan 14 and at the outside of the support leg 24 to the propeller fan 14.

(17) The upper guide plate 161 and the lower guide plate 162 are disposed to be substantially perpendicular to the flow of the air at the outside of the support leg 24 at the suction side of the propeller fan 14, or disposed to be inclined in the direction confronting the air flow direction. Therefore, the air at the suction side of the propeller can be surely captured by the upper guide plate 161 and the lower guide plate 162 and guided to the propeller fan 14.

What is claimed is:

1. An air conditioner comprising an indoor heat exchanger, an indoor fan, an outdoor heat exchanger and an outdoor fan which are integrally equipped, the indoor heat exchanger and the indoor fan being disposed in an indoor-side chamber while the outdoor heat exchanger and the outdoor fan is disposed in an outdoor-side chamber, the indoor-side chamber and the outdoor-side chamber being partitioned by a partition plate, characterized in that said partition plate is equipped with a top panel having a ventilation opening portion through which the outside air is supplied from said outdoor-side chamber into said indoor-side chamber, and a ventilation shutter for opening/closing said ventilation opening portion of said top panel at any open area ratio to freely adjust the opening degree of said ventilation opening portion.

2. The air conditioner as claimed in claim 1, wherein said ventilation shutter is secured to said top panel so as to be freely slidable, and the opening degree of said ventilation opening portion is freely adjusted through the sliding motion of said ventilation shutter.

3. The air conditioner as claimed in claim 1, further comprising a cabinet, wherein said cabinet is designed in a sleeve shape, and the surrounding of said outdoor-side chamber is compartmented by said cabinet, and said top panel of said partition plate is disposed inside said cabinet.

4. The air conditioner as claimed in claim 1, wherein said top panel of said partition plate is designed to be downwardly inclined to said outdoor-side chamber.

5. The air conditioner as claimed in claim 1, further comprising a fan casing disposed between said partition plate and said indoor fan in said indoor-side chamber, wherein vent ports are formed at the lower portion of said fan casing, and the outside air introduced from said ventilation opening portion of said partition plate into said indoor-side chamber is guided to said indoor fan through said vent ports.

6. The air conditioner as claimed in claim 1, wherein said ventilation opening portion comprises plural ventilation ports that are formed in said top panel in juxtaposition with one another.

7. The air conditioner as claimed in claim 6, wherein said ventilation shutter is equipped with a large number of fine holes each having an opening area smaller than each of said ventilation ports.

8. The air conditioner as claimed in claim 1, wherein said ventilation shutter is equipped with a lever extending to said indoor-side heat exchanger side, the opening degree of said ventilation ports being adjusted by sliding said lever.

* * * * *